US011231217B2

(12) United States Patent
Mitchell

(10) Patent No.: US 11,231,217 B2
(45) Date of Patent: Jan. 25, 2022

(54) ICE MAKING ASSEMBLY FOR A REFRIGERATOR APPLIANCE

(71) Applicant: Haier US Appliance Solutions, Inc., Wilmington, DE (US)

(72) Inventor: Alan Joseph Mitchell, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 209 days.

(21) Appl. No.: 16/532,608

(22) Filed: Aug. 6, 2019

(65) Prior Publication Data

US 2021/0041154 A1 Feb. 11, 2021

(51) Int. Cl.

| | |
|---|---|
| ***F25C 1/243*** | (2018.01) |
| ***F25C 1/04*** | (2018.01) |
| ***F25C 1/25*** | (2018.01) |
| ***F25C 5/20*** | (2018.01) |
| ***F25C 5/182*** | (2018.01) |

(52) U.S. Cl.

CPC ..... *F25C 1/243* (2013.01); *F25C 1/04* (2013.01); *F25C 1/25* (2018.01); *F25C 5/182* (2013.01); *F25C 5/22* (2018.01); *F25C 2400/10* (2013.01); *F25C 2400/14* (2013.01); *F25C 2500/08* (2013.01)

(58) Field of Classification Search

CPC .... F25C 1/243; F25C 1/04; F25C 1/25; F25C 5/22; F25C 5/182; F25C 2500/08; F25C 2400/10; F25C 2400/14; F25C 5/06; F25C 5/08

See application file for complete search history.

(56) References Cited

U.S. PATENT DOCUMENTS

| | | | | |
|---|---|---|---|---|
| 3,163,018 | A * | 12/1964 | Shaw | F25C 1/04 62/137 |
| 5,056,321 | A | 10/1991 | Patrick | |
| 8,037,697 | B2 | 10/2011 | LeClear et al. | |
| 2019/0078824 | A1* | 3/2019 | Yun | F25C 5/187 |
| 2020/0080759 | A1* | 3/2020 | Shi | F25C 5/08 |

FOREIGN PATENT DOCUMENTS

| | | | |
|---|---|---|---|
| KR | 100611496 | B1 | 8/2006 |
| KR | 20060107666 | A | 10/2006 |

* cited by examiner

*Primary Examiner* — Ana M Vazquez
(74) *Attorney, Agent, or Firm* — Dority & Manning, P.A.

(57) ABSTRACT

An ice making assembly for a refrigerator appliance includes a resilient silicone mold defining a mold cavity and a lifter mechanism positioned below the resilient mold for selectively deforming the mold and raising the ice cubes formed therein. A sweep assembly is positioned over the resilient mold and moves to an extended position after the cubes are raised to discharge the ice cubes at a top of the ice making assembly. A fill cup is positioned above the resilient mold for selectively filling the mold cavity with water and a heating element in thermal communication with the fill cup for selectively heating the fill cup to prevent ice jams or clogging.

20 Claims, 12 Drawing Sheets

ICE MAKING ASSEMBLY FOR A REFRIGERATOR APPLIANCE

FIELD OF THE INVENTION

The present subject matter relates generally to refrigerator appliances, and more particularly to ice making assemblies for refrigerator appliances.

BACKGROUND OF THE INVENTION

Refrigerator appliances generally include a cabinet that defines one or more chilled chambers for receipt of food articles for storage. Typically, one or more doors are rotatably hinged to the cabinet to permit selective access to food items stored in the chilled chamber. Further, refrigerator appliances commonly include ice making assemblies mounted within an icebox on one of the doors or in a freezer compartment. The ice is stored in a storage bin and is accessible from within the freezer chamber or may be discharged through a dispenser recess defined on a front of the refrigerator door.

However, conventional ice making assemblies are large, inefficient, and experience a variety of performance related issues. For example, conventional twist tray icemakers include a partitioned plastic mold that is physically deformed to break the bond formed between ice and the tray. However, these icemakers require additional room to fully rotate and twist the tray. In addition, the ice cubes are frequently fractured during the twisting process. When this occurs, a portion of the cubes may remain in the tray, thus resulting in overfilling during the next fill process.

Conventional crescent cube icemakers use a sweep arm to pass through the ice mold and eject the ice cubes. However, water may freeze in locations that cause the sweep arm to jam, resulting in an ejection failure and a stall in the ice making process. Certain conventional icemakers include a harvest heater that helps to release ice cubes from the mold, but such heaters are typically placed far from the water discharge spout where ice buildup may occur. As a result, these harvest heaters must be turned on for a long period of time in order to melt the entire cube and the clogged water spout, thus increasing energy consumption and adding significant time to the cube formation process.

Accordingly, a refrigerator appliance with features for improved ice dispensing would be desirable. More particularly, an ice making assembly for a refrigerator appliance that is compact, efficient, reliable, and resistant to clogging or jamming would be particularly beneficial.

BRIEF DESCRIPTION OF THE INVENTION

Aspects and advantages of the invention will be set forth in part in the following description, or may be apparent from the description, or may be learned through practice of the invention.

According to an exemplary embodiment, an ice making assembly for a refrigerator appliance is provided. The ice making assembly includes a resilient mold defining a mold cavity and a fill cup positioned above the resilient mold for selectively filling the mold cavity with water. A heat exchanger is in thermal communication with the resilient mold to freeze the water and form one or more ice cubes and a heating element is in thermal communication with the fill cup for selectively heating the fill cup.

According to another exemplary embodiment, a refrigerator appliance defining a vertical direction, a lateral direction, and a transverse direction is provided. The refrigerator appliance includes a cabinet defining a chilled chamber, a door being rotatably mounted to the cabinet to provide selective access to the chilled chamber, and an icebox mounted to the door and defining an ice making chamber. An ice making assembly is positioned within the ice making chamber and includes a resilient mold defining a mold cavity and a fill cup positioned above the resilient mold for selectively filling the mold cavity with water. A heat exchanger is in thermal communication with the resilient mold to freeze the water and form one or more ice cubes and a heating element is in thermal communication with the fill cup for selectively heating the fill cup.

In still another exemplary embodiment, an ice making assembly for a refrigerator appliance is provided. The ice making assembly includes a mold defining a mold cavity and a fill cup positioned above the mold for discharging water into the mold. A sweep arm is rotatably mounted to the mold and comprising a radial projections that sweeps through the mold cavity and a heating element is positioned within the fill cup for selectively heating the fill cup.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
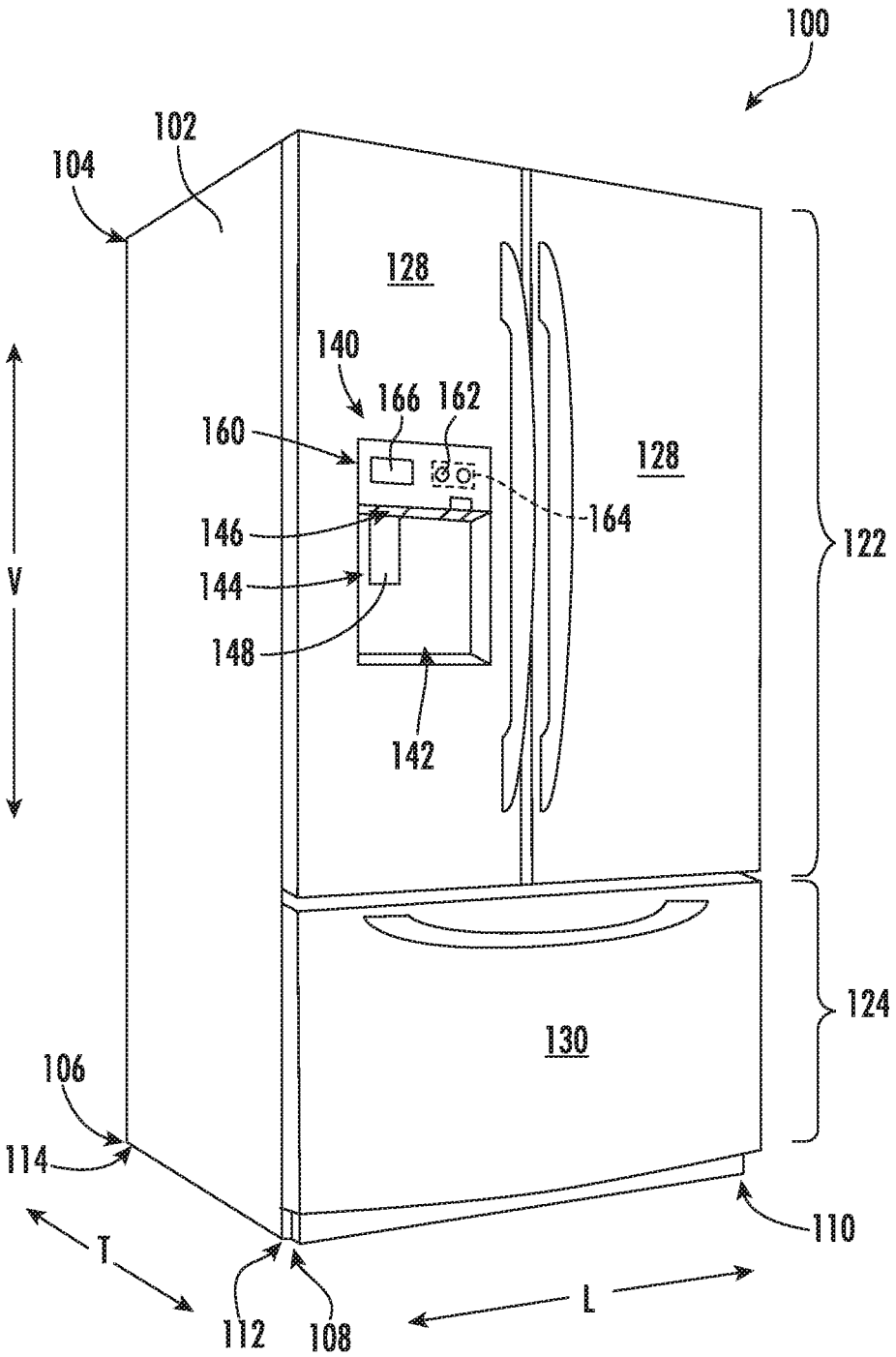
FIG. 1 provides a perspective view of a refrigerator appliance according to an exemplary embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective view of a refrigerator appliance 100 according to an exemplary embodiment of the present subject matter. Refrigerator appliance 100 includes a cabinet or housing 102 that extends between a top 104 and a bottom 106 along a vertical direction V, between a first side 108 and a second side 110 along a lateral direction L, and between a front side 112 and a rear side 114 along a transverse direction T. Each of the vertical direction V, lateral direction L, and transverse direction T are mutually perpendicular to one another.

Housing 102 defines chilled chambers for receipt of food items for storage. In particular, housing 102 defines fresh food chamber 122 positioned at or adjacent top 104 of housing 102 and a freezer chamber 124 arranged at or adjacent bottom 106 of housing 102. As such, refrigerator appliance 100 is generally referred to as a bottom mount refrigerator. It is recognized, however, that the benefits of the present disclosure apply to other types and styles of refrigerator appliances such as, e.g., a top mount refrigerator appliance, a side-by-side style refrigerator appliance, or a single door refrigerator appliance. Consequently, the description set forth herein is for illustrative purposes only and is not intended to be limiting in any aspect to any particular refrigerator chamber configuration.

Refrigerator doors 128 are rotatably hinged to an edge of housing 102 for selectively accessing fresh food chamber 122. In addition, a freezer door 130 is arranged below refrigerator doors 128 for selectively accessing freezer chamber 124. Freezer door 130 is coupled to a freezer drawer (not shown) slidably mounted within freezer chamber 124. Refrigerator doors 128 and freezer door 130 are shown in the closed configuration in FIG. 1. One skilled in the art will appreciate that other chamber and door configurations are possible and within the scope of the present invention.

Figure 2:
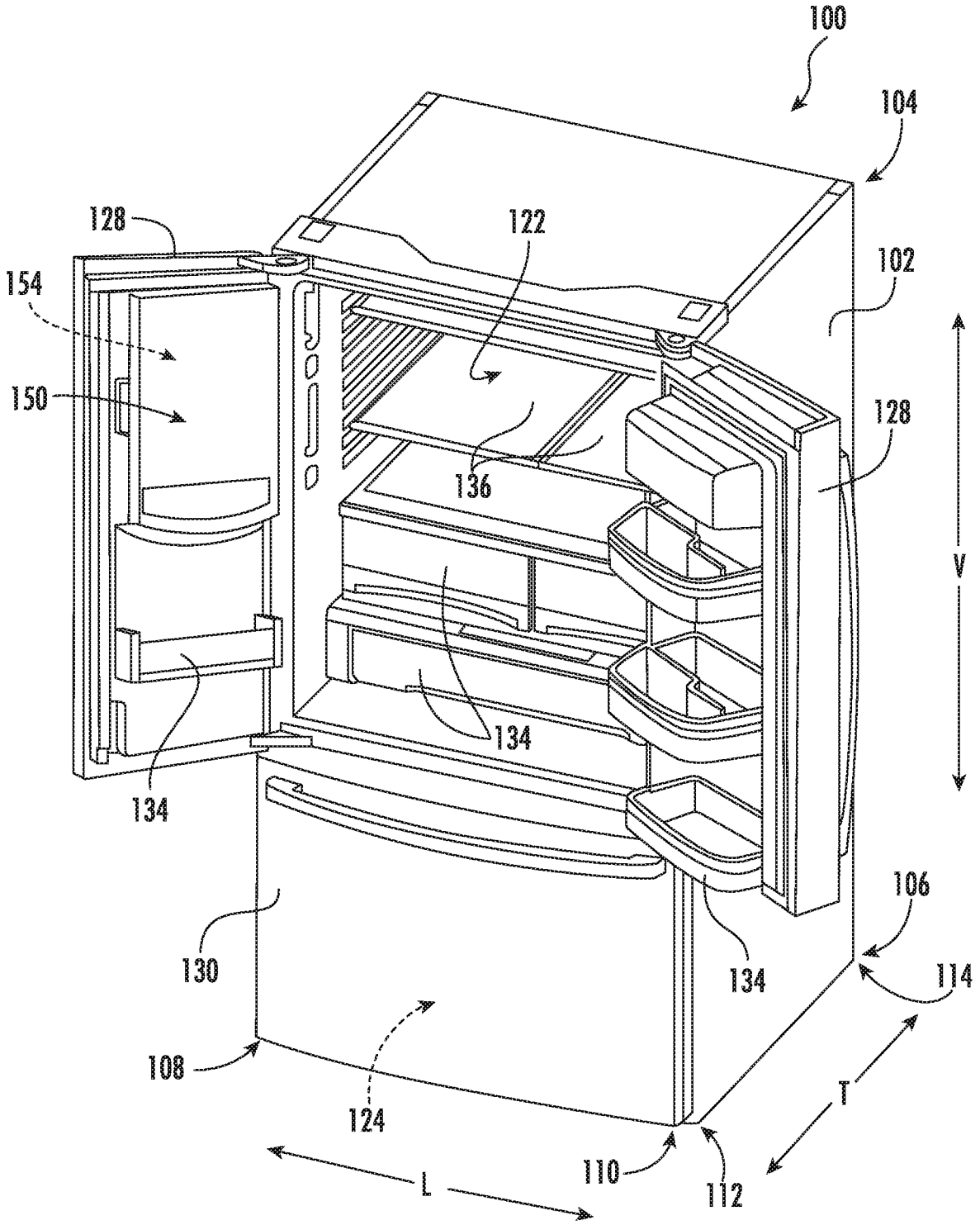
FIG. 2 provides a perspective view of the exemplary refrigerator appliance of FIG. 1, with the doors of the fresh food chamber shown in an open position.

FIG. 2 provides a perspective view of refrigerator appliance 100 shown with refrigerator doors 128 in the open position. As shown in FIG. 2, various storage components are mounted within fresh food chamber 122 to facilitate storage of food items therein as will be understood by those skilled in the art. In particular, the storage components may include bins 134 and shelves 136. Each of these storage components are configured for receipt of food items (e.g., beverages and/or solid food items) and may assist with organizing such food items. As illustrated, bins 134 may be mounted on refrigerator doors 128 or may slide into a receiving space in fresh food chamber 122. It should be appreciated that the illustrated storage components are used only for the purpose of explanation and that other storage components may be used and may have different sizes, shapes, and configurations.

Referring now generally to FIG. 1, a dispensing assembly 140 will be described according to exemplary embodiments of the present subject matter. Dispensing assembly 140 is generally configured for dispensing liquid water and/or ice. Although an exemplary dispensing assembly 140 is illustrated and described herein, it should be appreciated that variations and modifications may be made to dispensing assembly 140 while remaining within the present subject matter.

Dispensing assembly 140 and its various components may be positioned at least in part within a dispenser recess 142 defined on one of refrigerator doors 128. In this regard, dispenser recess 142 is defined on a front side 112 of refrigerator appliance 100 such that a user may operate dispensing assembly 140 without opening refrigerator door 128. In addition, dispenser recess 142 is positioned at a predetermined elevation convenient for a user to access ice and enabling the user to access ice without the need to bend-over. In the exemplary embodiment, dispenser recess 142 is positioned at a level that approximates the chest level of a user.

Dispensing assembly 140 includes an ice dispenser 144 including a discharging outlet 146 for discharging ice from dispensing assembly 140. An actuating mechanism 148, shown as a paddle, is mounted below discharging outlet 146 for operating ice or water dispenser 144. In alternative exemplary embodiments, any suitable actuating mechanism may be used to operate ice dispenser 144. For example, ice dispenser 144 can include a sensor (such as an ultrasonic sensor) or a button rather than the paddle. Discharging outlet 146 and actuating mechanism 148 are an external part of ice dispenser 144 and are mounted in dispenser recess 142.

Figure 3:
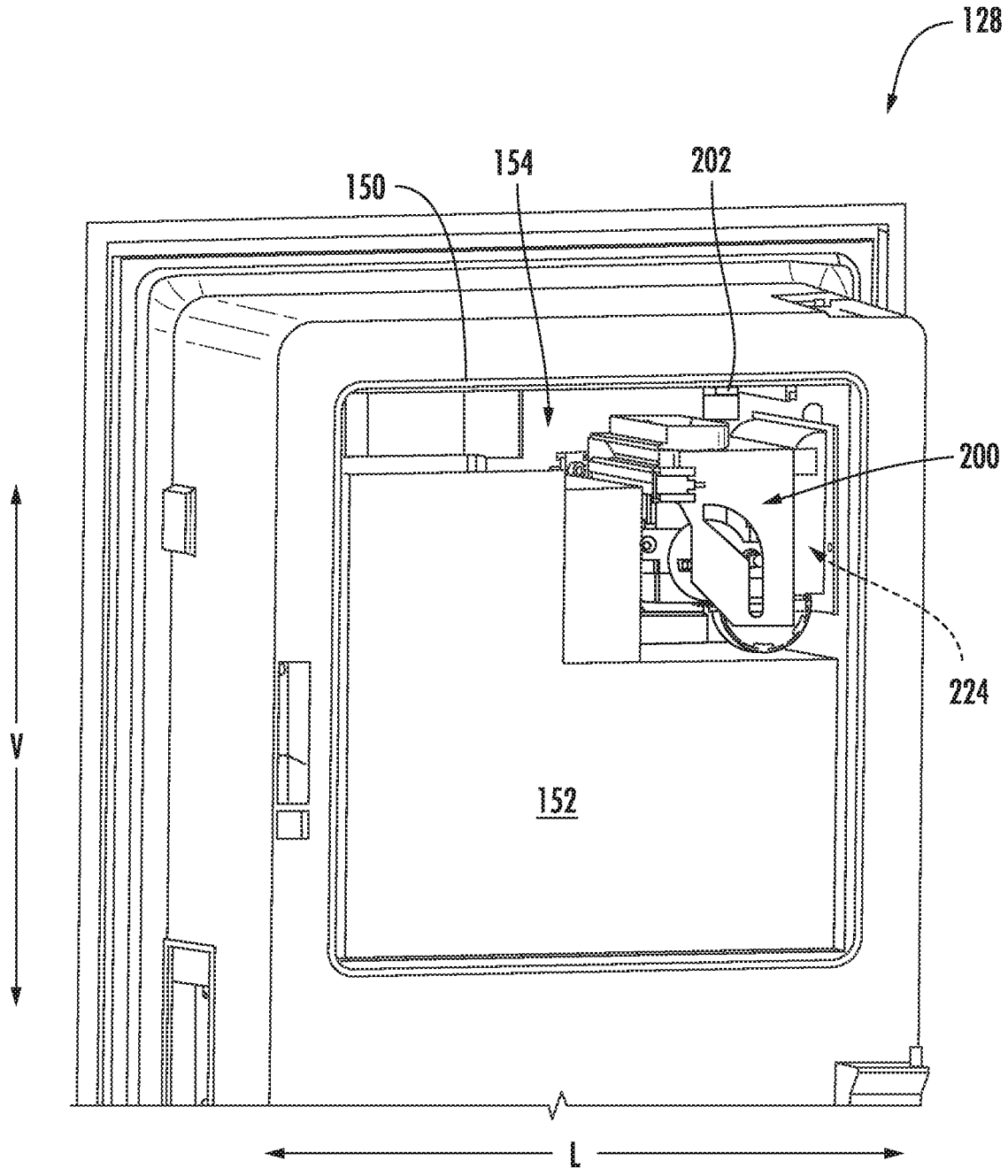
FIG. 3 provides a perspective view of an icebox and ice making assembly for use with the exemplary refrigerator appliance of FIG. 1 according to an exemplary embodiment of the present subject matter.
Figure 4:
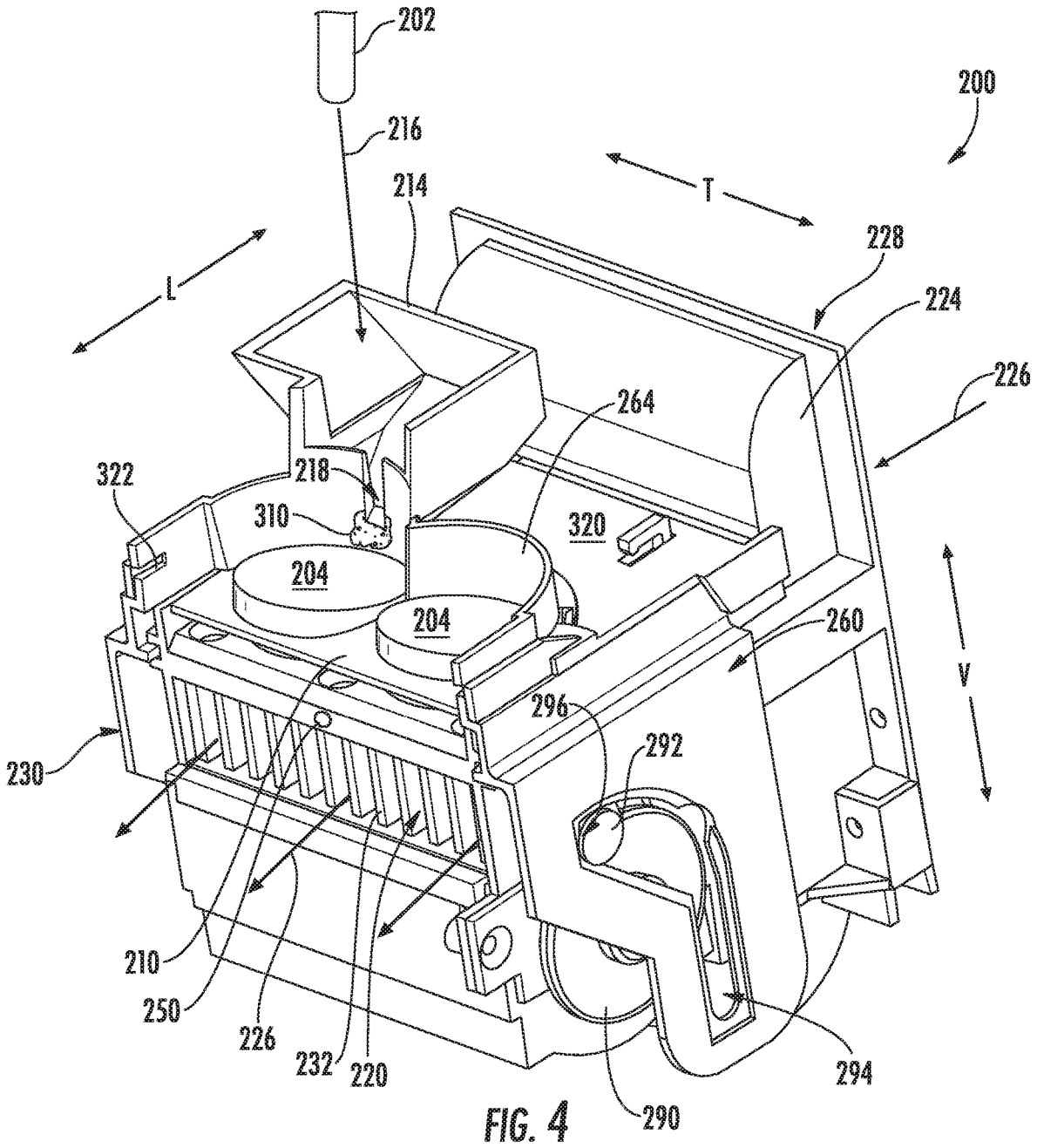
FIG. 4 provides a perspective view of the exemplary ice making assembly of FIG. 3 according to an exemplary embodiment of the present subject matter.

By contrast, inside refrigerator appliance 100, refrigerator door 128 may define an icebox 150 (FIGS. 2 and 3) housing an icemaker and an ice storage bin 152 that are configured to supply ice to dispenser recess 142. In this regard, for example, icebox 150 may define an ice making chamber 154 for housing an ice making assembly, a storage mechanism, and a dispensing mechanism.

A control panel 160 is provided for controlling the mode of operation. For example, control panel 160 includes one or more selector inputs 162, such as knobs, buttons, touch-screen interfaces, etc., such as a water dispensing button and an ice-dispensing button, for selecting a desired mode of operation such as crushed or non-crushed ice. In addition, inputs 162 may be used to specify a fill volume or method of operating dispensing assembly 140. In this regard, inputs 162 may be in communication with a processing device or controller 164. Signals generated in controller 164 operate refrigerator appliance 100 and dispensing assembly 140 in response to selector inputs 162. Additionally, a display 166, such as an indicator light or a screen, may be provided on control panel 160. Display 166 may be in communication with controller 164, and may display information in response to signals from controller 164.

As used herein, "processing device" or "controller" may refer to one or more microprocessors or semiconductor devices and is not restricted necessarily to a single element. The processing device can be programmed to operate refrigerator appliance 100 and dispensing assembly 140. The processing device may include, or be associated with, one or more memory elements (e.g., non-transitory storage media). In some such embodiments, the memory elements include electrically erasable, programmable read only memory (EEPROM). Generally, the memory elements can store information accessible processing device, including instructions that can be executed by processing device. Optionally, the instructions can be software or any set of instructions and/or data that when executed by the processing device, cause the processing device to perform operations.

Referring now generally to FIGS. 3 through 7, an ice making assembly 200 that may be used with refrigerator appliance 100 will be described according to exemplary embodiments of the present subject matter. As illustrated, ice making assembly 200 is mounted on icebox 150 within ice making chamber 154 and is configured for receiving a flow of water from a water supply spout 202 (see, e.g., FIG. 3). More specifically, as described in more detail below, water supply spout 202 may discharge a flow of water into a fill cup that disperses or directs the water into one or more mold cavities.

In this manner, ice making assembly 200 is generally configured for freezing the water to form ice cubes 204 (see FIGS. 5 and 6) which may be stored in storage bin 152 and dispensed through discharging outlet 146 by dispensing assembly 140. However, it should be appreciated that ice making assembly 200 is described herein only for the purpose of explaining aspects of the present subject matter. Variations and modifications may be made to ice making assembly 200 while remaining within the scope of the present subject matter. For example, ice making assembly 200 could instead be positioned within freezer chamber 124 of refrigerator appliance 100 and may have any other suitable configuration.

According to the illustrated embodiment, ice making assembly 200 includes a resilient mold 210 that defines a mold cavity 212. In general, as described in more detail below, resilient mold 210 is positioned for receiving the gravity-assisted flow of water from water supply spout 202 and containing that water until ice cubes 204 are formed. Resilient mold 210 may be constructed from any suitably resilient material that may be deformed to release ice cubes 204 after formation. For example, according to the illustrated embodiment, resilient mold 210 is formed from silicone or another suitable hydrophobic, food-grade, and resilient material.

According to the illustrated embodiment, resilient mold 210 defines two mold cavities 212, each being shaped and oriented for forming a separate ice cube 204. In this regard, for example, water supply spout 202 is configured for refilling resilient mold 210 to a level above a divider wall (not shown) within resilient mold 210 such that the water overflows into the two mold cavities 212 evenly. According still other embodiments, water supply spout 202 could have a dedicated discharge nozzle positioned over each mold cavity 212. Furthermore, it should be appreciated that according to alternative embodiments, ice making assembly 200 may be scaled to form any suitable number of ice cubes 204, e.g., by increasing the number of mold cavities 212 defined by resilient mold 210.

As shown, ice making assembly further includes a fill cup 214 that is positioned above resilient mold 210 for selectively filling mold cavity 212 with water. More specifically, fill cup 214 may be positioned below water supply spout 202 for receiving a flow of water 216. The fill cup 214 may define a small reservoir for collecting and/or directing the flow of water 216 into mold cavity 212 without excessive splashing or spilling. In addition, fill cup 214 may define a discharge spout 218 that funnels water toward the bottom of the fill cup 214 where it may be dispensed into mold cavity 212.

In general, fill cup 214 and discharge spout 218 may have any suitable size, shape, and configuration suitable for dispensing the flow of water 216 into resilient mold 210. For example, according to the illustrated embodiment, fill cup 214 is positioned over one of the two mold cavities 212 and generally defines sloped surfaces for directing the flow of water 216 to discharge spout 218 immediately above a fill level (not labeled) of the resilient mold 210. According to alternative embodiments, fill cup 214 may extend across a width of the entire resilient mold 210 and may have multiple discharge spouts 218. Fill cup 214 may have still other configurations while remaining within the scope of the present subject matter.

Ice making assembly 200 may further include a heat exchanger 220 which is in thermal communication with resilient mold 210 for freezing the water within mold cavities 212 to form one or more ice cubes 204. In general, heat exchanger 220 may be formed from any suitable thermally conductive material and may be positioned in direct contact with resilient mold 210. Specifically, according to the illustrated embodiment, heat exchanger 220 is formed from aluminum and is positioned directly below resilient mold 210. Furthermore, heat exchanger 220 may define a cube recess 222 which is configured to receive resilient mold 210 and shape or define the bottom of ice cubes 204. In this manner, heat exchanger 220 is in direct contact with resilient mold 210 over a large portion of the surface area of ice cubes 204, e.g., to facilitate quick freezing of the water stored within mold cavities 212. For example, heat exchanger 220 may contact resilient mold 210 over greater than approximately half of the surface area of ice cubes 204. It should be appreciated that as used herein, terms of approximation, such as "approximately," "substantially," or "about," refer to being within a ten percent margin of error.

In addition, ice making assembly 200 may comprise an inlet air duct 224 that is positioned adjacent heat exchanger 220 and is fluidly coupled with a cool air supply (e.g., illustrated as a flow of cooling air 226). According to the illustrated embodiment, inlet air duct 224 provides the flow of cooling air 226 from a rear end 228 of ice making assembly 200 (e.g., from the right along the lateral direction L as shown in FIGS. 5 and 6) through heat exchanger 220 toward a front end 230 of ice making assembly 200 (e.g., to the left along the lateral direction L as shown in FIGS. 5 and 6, i.e., the side where ice cubes 204 are discharged into storage bin 152).

As shown, inlet air duct 224 generally receives the flow of cooling air 226 from a sealed system of refrigerator appliance 100 and directs it over and/through heat exchanger 220 to cool heat exchanger 220. More specifically, according to the illustrated embodiment, heat exchanger 220 defines a plurality of heat exchange fins 232 that extend substantially parallel to the flow of cooling air 226. In this regard, heat exchange fins 232 extend down from a top of heat exchanger 220 along a plane defined by the vertical direction V in the lateral direction L (e.g., when ice making assembly 200 is installed in refrigerator appliance 100).

Figure 5:
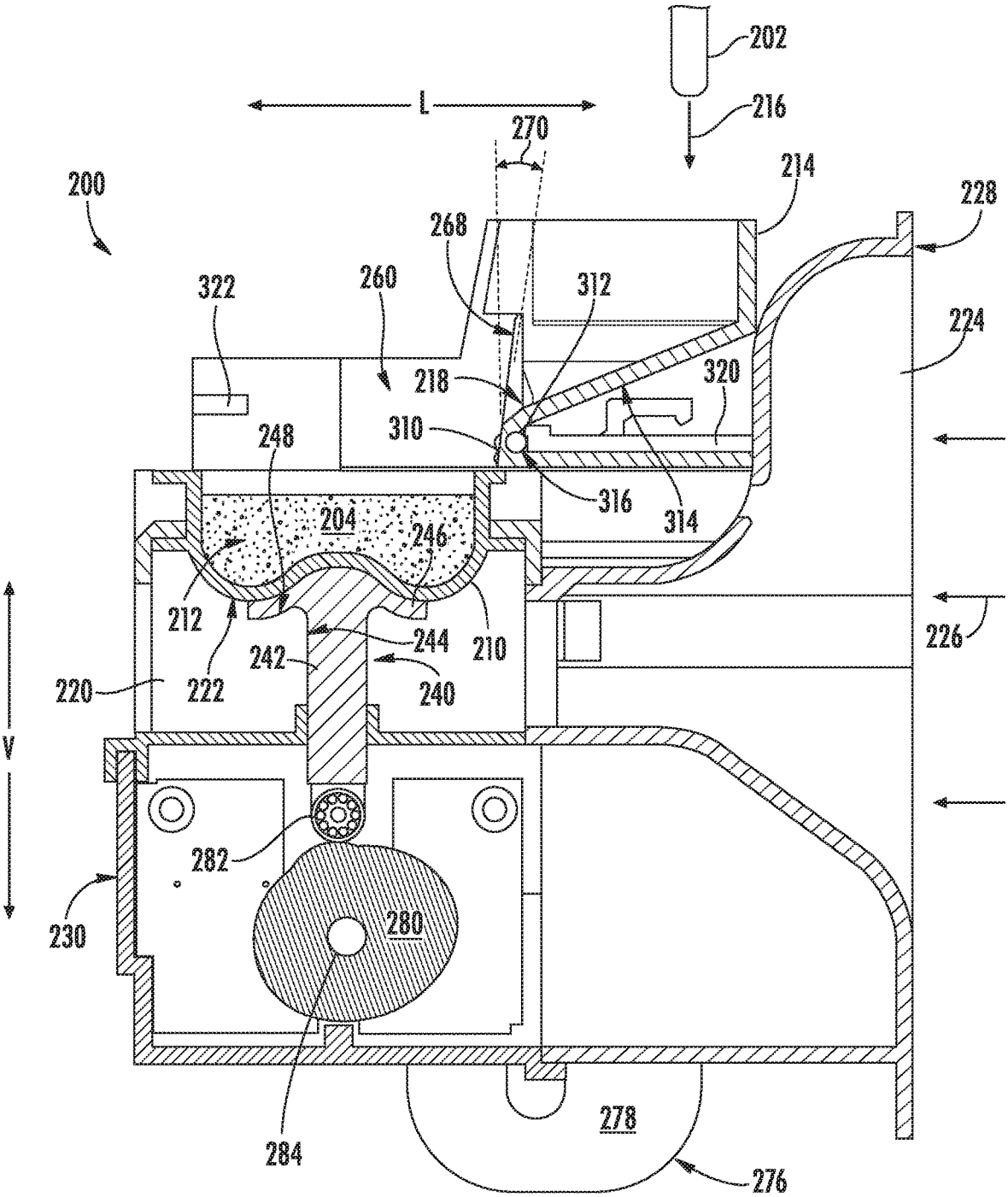
FIG. 5 provides a partial side view of a drive mechanism, a lifter assembly, and a sweep assembly of the exemplary ice making assembly of FIG. 3, with the lifter assembly in a lowered position and the sweep assembly in the retracted position.
Figure 6:
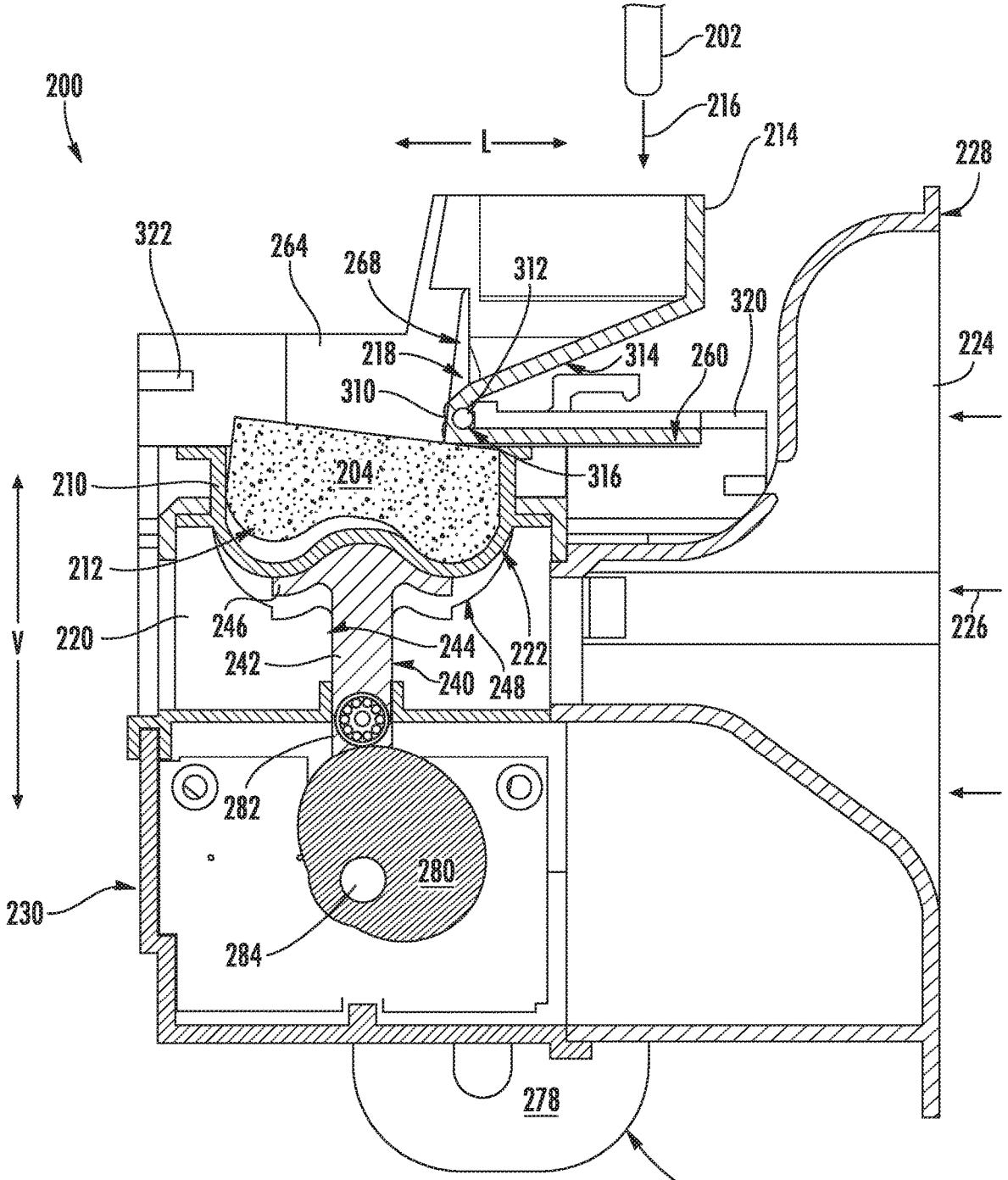
FIG. 6 provides a partial side view of the drive mechanism, the lifter assembly, and the sweep assembly of FIG. 5, with the lifter mechanism in the raised position.

As best shown in FIGS. 5 and 6, ice making assembly 200 further includes a lifter mechanism 240 that is positioned below resilient mold 210 and is generally configured for facilitating the ejection of ice cubes 204 from mold cavities 212. In this regard, lifter mechanism 240 is movable between a lowered position (e.g., as shown in FIG. 5) and a raised position (e.g., as shown in FIG. 6). Specifically, lifter mechanism 240 includes a lifter arm 242 that extends substantially along the vertical direction V and passes through a lifter channel 244 defined within heat exchanger 220. In this manner, lifter channel 244 may guide lifter mechanism 240 as it slides along the vertical direction V.

In addition, lifter mechanism 240 comprises a lifter projection 246 that extends from a top of lifter arm 242 towards a rear end 228 of ice making assembly 200 and towards a front end 230 of ice making assembly 200. As illustrated, lifter projection 246 generally defines the profile of the bottom of ice cubes 204 and is positioned flush within a lifter recess 248 defined by heat exchanger 220 when lifter mechanism 240 is in the lowered position. In this manner, heat exchanger 220 and lifter projection 246 define a smooth bottom surface of ice cubes 204. More specifically, according to the illustrated embodiment, lifter projection 246 generally curves down and away from lifter arm 242 to define a smooth divot on a bottom of ice cubes 204.

Figure 7:
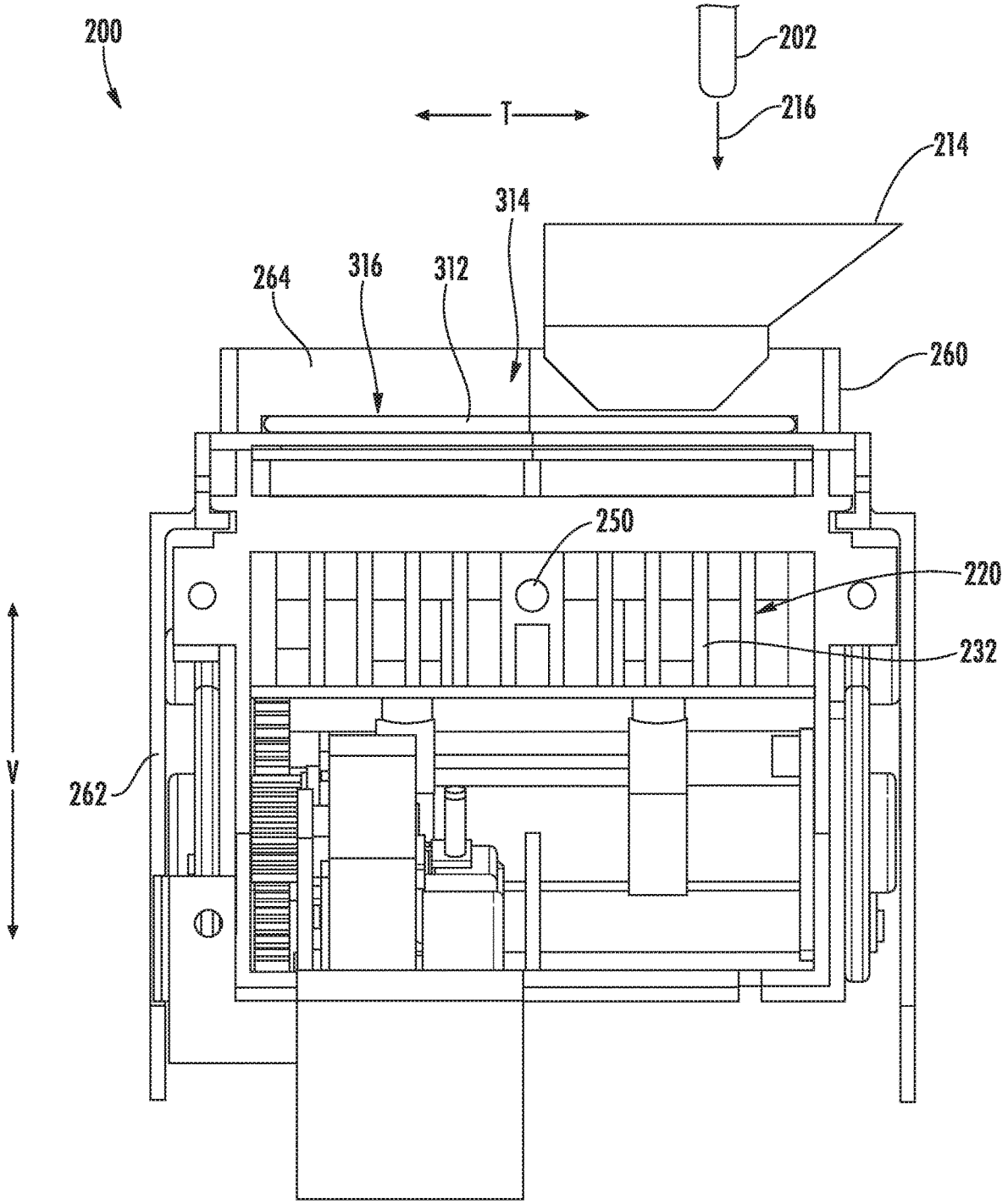
FIG. 7 provides a rear view of the exemplary ice making assembly of FIG. 3 according to an exemplary embodiment with a retention bracket removed for clarity.

Referring now specifically to FIG. 7, heat exchanger 220 may further define a hole for receiving a temperature sensor 250 which is used to determine when ice cubes 204 have been formed such that an ejection process may be performed. In this regard, for example, temperature sensor 250 may be in operative communication with controller 164 which may monitor the temperature of heat exchanger 220 and the time water has been in mold cavities 212 to predict when ice cubes 204 have been fully frozen. As used herein, "temperature sensor" may refer to any suitable type of temperature sensor. For example, the temperature sensors may be thermocouples, thermistors, or resistance temperature detectors. In addition, although exemplary positioning of a single temperature sensor 250 is illustrated herein, it should be appreciated that ice making assembly 200 may include any other suitable number, type, and position of temperature sensors according to alternative embodiments.

Referring now specifically to FIGS. 4 through 7, ice making assembly 200 further includes a sweep assembly 260 which is positioned over resilient mold 210 and is generally configured for pushing ice cubes 204 out of mold cavities 212 and into storage bin 152 after they are formed. Specifically, according to the illustrated embodiment, sweep assembly 260 is movable along the horizontal direction (i.e., as defined by the lateral direction L and the transverse direction T) between a retracted position (e.g., as shown in FIG. 5) and an extended position (e.g., as shown in FIG. 6). According to the illustrated embodiment, sweep assembly 260 and fill cup 214 may be integrally formed as a single piece, with fill cup 214 being positioned on top of sweep assembly 260. In this manner, sweep assembly 260 and fill cup 214 may move in unison along the lateral direction L during the ice discharge process.

As described in detail below, sweep assembly 260 remains in the retracted position while water is added to resilient mold 210, i.e., through fill cup 214. Throughout the entire freezing process, and as lifter mechanism 240 is moved towards the raised position. After ice cubes 204 are in the raised position, sweep assembly 260 moves horizontally from the retracted to the extended position, i.e., toward front end 230 of ice making assembly 200. In this manner, sweep assembly pushes ice cubes 204 off of lifter mechanism 240, out of resilient mold 210, and over a top of heat exchanger 220 where they may fall into storage bin 152.

Notably, dispensing ice cubes 204 from the top of ice making assembly 200 permits a taller storage bin 152, and thus a larger ice storage capacity relative to ice making machines that dispense ice from a bottom of the icemaker. According to the illustrated embodiment, water supply spout 202 is positioned above fill cup 214 (in the retracted position) such that the flow of water may be directed into resilient mold 210. In addition, water supply spout 202 is positioned such that sweep assembly 260 may move between the retracted position and an extended position without contacting water supply spout 202. According to alternative embodiments, water supply spout 202 may be coupled to mechanical actuator which lowers water supply spout 202 close to resilient mold 210 while sweep assembly 260 is in the retracted position. In this manner, the overall height or profile of ice making assembly 200 may be further reduced, thereby maximizing ice storage capacity and minimizing wasted space.

According to the illustrated embodiment, sweep assembly 260 generally includes vertically extending side arms 262 that are used to drive a raised frame 264 that is positioned over top of resilient mold 210. Specifically, raised frame 264 extends around resilient mold 210 prevents splashing of water within resilient mold 210. This is particularly important when ice making assembly 200 is mounted on refrigerator door 128 because movement of refrigerator door 128 may cause sloshing of water within mold cavities 212.

In addition, as best shown in FIGS. 5 and 6, sweep assembly 260 may further define an angled pushing surface 268 proximate rear end 228 of ice making assembly 200. In general, angled pushing surface 268 is configured for engaging ice cubes 204 while they are pivoted upward and as sweep assembly 260 is moving toward the extended position to rotate ice cubes 204 over and out of ice making assembly 200. Specifically, angled pushing surface may extend at an angle 270 relative to the vertical direction V. According to the illustrated embodiment, angle 270 is less than about 10 degrees, though any other suitable angle for urging ice cubes to rotate 180 degrees may be used according to alternative embodiments.

Referring again generally to FIGS. 4 through 7, ice making assembly 200 may include a drive mechanism 276 which is operably coupled to both lifter mechanism 240 and sweep assembly 260 to selectively raise lifter mechanism 240 and slide sweep assembly 260 to discharge ice cubes 204 during operation. Specifically, according to the illustrated embodiment, drive mechanism 276 comprises a drive motor 278. As used herein, "motor" may refer to any suitable drive motor and/or transmission assembly for rotating a system component. For example, motor 178 may be a brushless DC electric motor, a stepper motor, or any other suitable type or configuration of motor. Alternatively, for example, motor 178 may be an AC motor, an induction motor, a permanent magnet synchronous motor, or any other suitable type of AC motor. In addition, motor 178 may include any suitable transmission assemblies, clutch mechanisms, or other components.

According to an exemplary embodiment, motor 178 may be mechanically coupled to a rotating cam 280. Lifter mechanism 240, or more specifically lifter arm 242, may ride against rotating cam 280 such that the profile of rotating cam 280 causes lifter mechanism 240 move between the lowered position and the raised position as motor 278 rotates rotating cam 280. In addition, according to exemplary embodiment, lifter mechanism 240 may include a roller 282 mounted to the lower end of lifter arm 242 for providing a low friction interface between lifter mechanism 240 and rotating cam 280.

Ice making assembly 200 may include a plurality of lifter mechanisms 240, each of the lifter mechanisms 240 being positioned below one of the ice cubes 204 within resilient mold 210 or being configured to raise a separate portion of resilient mold 210. In such an embodiment, rotating cams 280 are mounted on a cam shaft 284 which is mechanically coupled with motor 278. As motor 278 rotates cam shaft 284, rotating cams 280 may simultaneously move lifter arms 242 along the vertical direction V. In this manner, each of the plurality of rotating cams 280 may be configured for driving a respective one lifter mechanism 240. In addition, a roller axle (not shown) may extend between rollers 282 of adjacent lifter mechanisms 240 to maintain a proper distance between adjacent rollers 282 and to keep them engaged on top of rotating cams 280.

Referring still generally to FIGS. 4 through 7, drive mechanism 276 may further include a yoke wheel 290 which is mechanically coupled to motor 278 for driving sweep assembly 260. Specifically, yoke wheel 290 may rotate along with cam shaft 284 and may include a drive pin 292 positioned at a radially outer portion of yoke wheel 290 and extending substantially parallel to an axis of rotation of motor 278. In addition, side arms 262 of sweep assembly 260 may define a drive slot 294 which is configured to receive drive pin 292 during operation. Although a single yoke wheel 290 is described and illustrated herein, it should be appreciated that both side arms 262 may include yoke wheel 290 and drive slot 294 mechanisms.

Notably, the geometry of each drive slot 294 is defined such that drive pin 292 moves sweep assembly 260 along the horizontal direction when drive pin 292 reaches an end 296 of drive slot 294. Notably, according to an exemplary embodiment, this occurs when lifter mechanism 240 is in the raised position. In order to provide controller 164 with knowledge of the position of yoke wheel 290 (and drive mechanism 276 more generally), ice making assembly 200 may include a position sensor (not shown) for determining a zero position of yoke wheel 290.

According to an exemplary embodiment, the position sensor includes a magnet (not shown) positioned on yoke wheel 290 and a hall-effect sensor (not shown) mounted at a fixed position on ice making assembly 200. As yoke wheel 290 is rotated toward a predetermined position, the hall-effect sensor can detect the proximity of the magnet and controller 164 may determine that yoke wheel 290 is in the zero position (or some other known position). Alternatively, any other suitable sensors or methods of detecting the position of yoke wheel 290 or drive mechanism 276 may be used. For example, motion sensors, camera systems, optical sensors, acoustic sensors, or simple mechanical contact switches may be used according to alternative embodiments.

According to an exemplary embodiment the present subject matter, motor 278 may begin to rotate after ice cubes 204 are completely frozen and ready for harvest. In this regard, motor 278 rotates rotating cam 280 (and/or cam shaft 284) approximately 90 degrees to move lifter mechanism 240 from the lowered position to the raised position. In this manner, lifter projection 246 pushes resilient mold 210 upward, thereby deforming resilient mold 210 and releasing ice cubes 204. Ice cubes 204 continue to be pushed upward until they pass into storage bin 152.

Notably, yoke wheel 290 rotates with cam shaft 284 such that drive pin 292 rotates within drive slot 294 without moving sweep assembly 260 until yoke wheel 290 reaches the 90° position. Thus, as motor 278 rotates past 90 degrees, lifter mechanism 240 remains in the raised position while sweep assembly 260 moves towards the extended position. In this manner, angled pushing surface 268 engages the raised end of ice cubes 204 to push them out of resilient mold 210 and rotates ice cubes 204 approximately 180 degrees before dropping them into storage bin 152.

When motor 278 reaches 180 degrees rotation, sweep assembly 260 is in the fully extended position and ice cubes 204 will fall into storage bin 152 under the force of gravity. As motor 278 rotates past 180 degrees, drive pin 292 begins to pull sweep assembly 260 back toward the retracted position, e.g., via engagement with drive slot 294. Simultaneously, the profile of rotating cam 280 is configured to begin lowering lifter mechanism 240. When motor 278 is rotated back to the zero position, as indicated for example by position sensor 298, sweep assembly 260 may be fully retracted, lifter mechanism 240 may be fully lowered, and resilient mold 210 may be ready for a supply fresh water. At this time, water supply spout 202 may provide a flow of fresh water into mold cavities 212 and the process may be repeated.

Notably, due to the proximity of fill cup 214 to cold air and temperatures necessary for forming ice cubes 204, water 216 dispensed from water supply spout 202 may have a tendency to freeze in locations where ice is not desirable. When such undesirable freezing occurs, the operation and performance of ice making assembly 200 may be negatively affected. For example, water fill volumes may be affected, resulting in ice cubes that are smaller or larger than desired. In addition, ice in the wrong places may cause water spills or may jam the discharge mechanisms of ice making assembly 200. Thus, aspects of the present subject matter are generally directed toward features for eliminating the buildup of ice in undesirable locations. These undesirable ice formations may be referred to herein as ice clogs and are identified generally in the figures by reference numeral 310 (see FIGS. 4-6, 8, and 10).

Specifically, ice making assembly 200 may include one or more heating elements 312 that are in thermal communication with fill cup 214 for selectively heating fill cup 214. As used herein, the term "heating element" and the like are generally intended to refer to any suitable electrically-driven heat generator. For instance, the heating element 312 may be an electric heater in conductive thermal engagement with fill cup 214 and may include one or more resistive heating elements. For example, positive thermal coefficient of resistance heaters (PTCR) that increase in resistance upon heating may be used, such as metal, ceramic, or polymeric PTC elements (e.g., such as electrical resistance heating rods or calrod heaters). In addition, heating elements 312 may be coated in silicone, embedded within fill cup 214, or positioned in any other suitable manner.

Heating element 312 may generally be mounted in any manner suitable for breaking up ice clogs 310 or melting undesirable ice buildup. In this regard, according to the exemplary embodiment, heating element 312 may be positioned adjacent discharge spout 218 of fill cup 214. In this regard, a common clogging location is at the point where discharge spout 218 directs the flow of water 216 into mold cavity to 12. Notably, the ice clog 310 at this location may prevent proper discharge or ejection of ice cubes 204 from mold cavities 212. In this regard, as lifter mechanism 240 pushes ice cube 204 up and out of resilient mold 210, a back end of ice cube 204 may contact ice clog 310 causing it to tilt forward. As sweep arm 260 moves forward to initiate the ejection process, ice cube 204 can get jammed between sweep arm 260 and a front of resilient mold 210.

To prevent such issued, heating element 312 may be selectively energized when such an ice clog 310 is detected to locally melt and break up the ice clog 310. Specifically, according to the illustrated embodiment, heating element 312 is positioned on a back side 314 of fill cup 214 immediately opposite discharge spout 218. In this regard, fill cup 214 may define a groove 316 that it is sized for receiving heating element 312. Groove 316 may be defined such that the thickness of fill cup 214 adjacent groove 316 is less than a nominal thickness of sweep arm 260 and fill cup 214. Thus, heating element 312 is positioned as close as possible to ice clog 310 without comprising the structural integrity of fill cup 214.

In addition, ice making assembly 200 may include a retention bracket 320 that snaps onto fill cup 214 or sweep arm 260 to secure heating element 312 in position. In this manner, retention bracket 320 may be a flat piece of plastic that is positioned firmly against heating element 312 opposite of fill cup 214. In this manner, heating element 312 may be in firm contact with fill cup 214 within groove 316 for improved thermal conductivity. As shown, retention bracket 320 may include clips 322 that are received within a notch defined on a front end of sweep arm 260 to secure retention bracket 320 in place. It should be appreciated that other configurations of retention bracket 320 and other means for securing heating element 312 may be used while remaining within the scope of the present subject matter.

Figure 8:
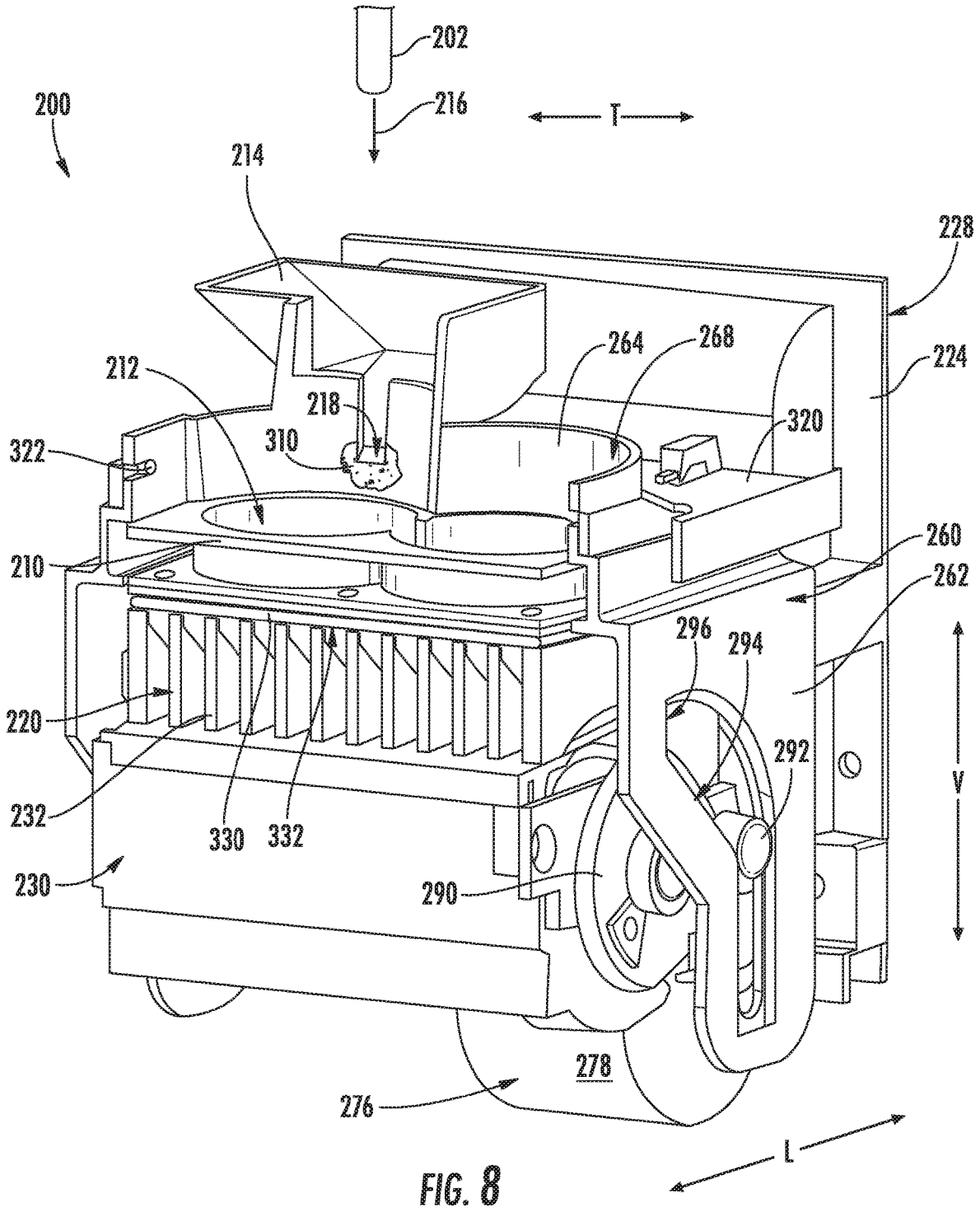
FIG. 8 provides a perspective view of an icebox and ice making assembly for use with the exemplary refrigerator appliance of FIG. 1 according to another exemplary embodiment of the present subject matter.
Figure 9:
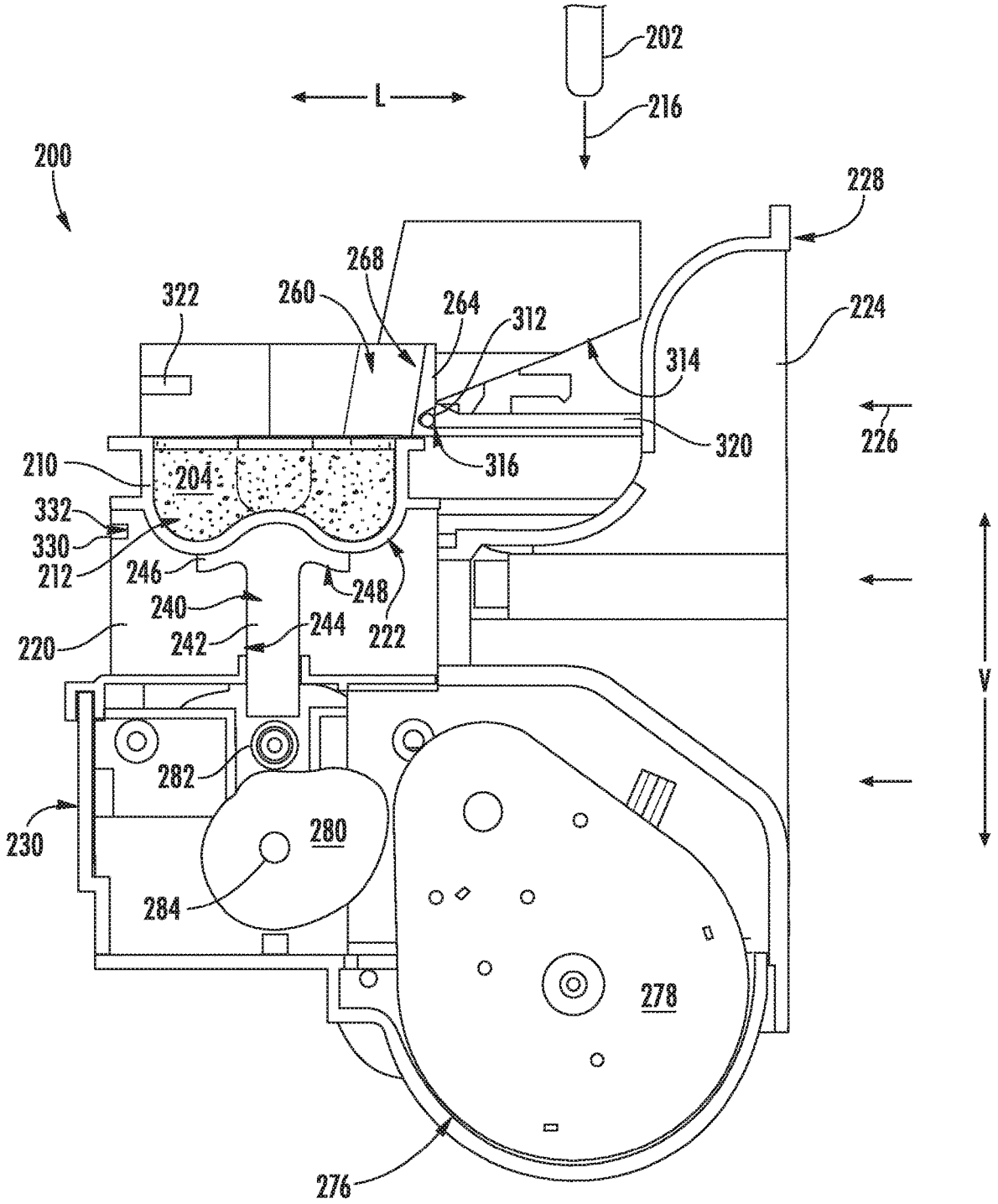
FIG. 9 provides a partial side view of a drive mechanism, a lifter assembly, and a sweep assembly of the exemplary ice making assembly of FIG. 8, with the lifter assembly in a lowered position and the sweep assembly in the retracted position.
Figure 10:
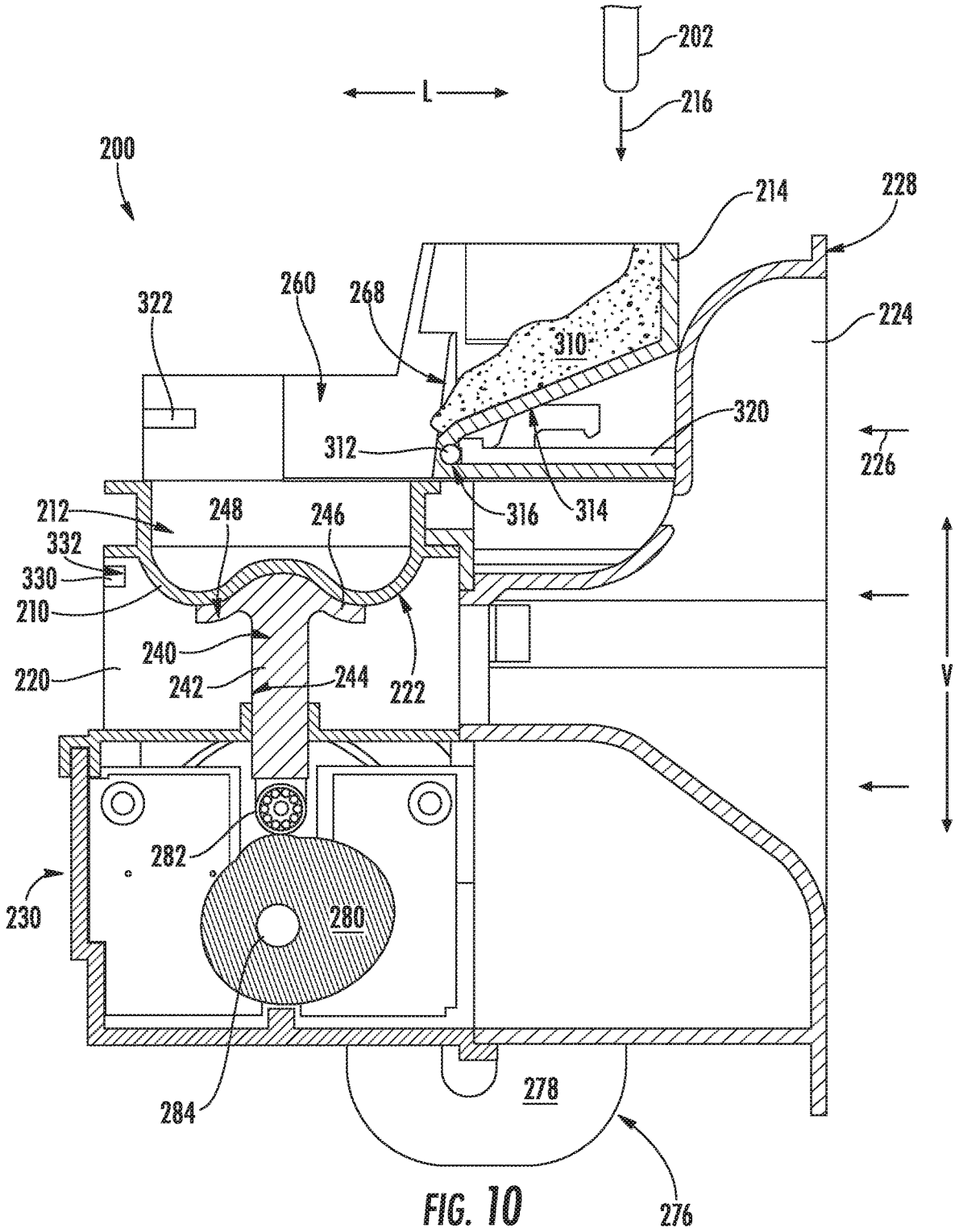
FIG. 10 provides a partial side view of the exemplary ice making assembly of FIG. 8 with an ice clog.

Notably, localized heating at discharge spout 218 may prevent ice clogs 310 at discharge spout 218, but may be ineffective at melting ice clogs 310 positioned elsewhere within ice making assembly 200. Thus, according to alternative embodiments, ice making assembly 200 may further include a secondary harvest heater 330 that is in thermal communication with heat exchanger 220. Specifically, as best shown in FIGS. 8 through 10, secondary harvest heater 330 is wrapped around heat exchanger 220 and in positioned within a recess 332 defined in heat exchanger 220. Thus, improved thermal contact between secondary harvest heater 330 and heat exchanger 220 may be achieved.

Notably, secondary harvest heater 330 may be used independently of or in conjunction with heating element 312 to clear ice clogs 310 throughout ice making assembly 200. For example, clogs 310 may commonly occur within fill cup 214 when water does not fully discharge through discharge spout 218. In cases of large clogs, heating element 312 may not sufficiently melt or break up the ice clog 310. However, secondary harvest heater 330 may be used in addition to heating element 312 to increase the total heat generation and result in a quicker and more effective ice removal process.

It is noted that although these exemplary embodiments are explicitly illustrated, one of ordinary skill in the art would understand that additional or alternative embodiments or configurations may be provided to include one or more features of these examples. For example, the type, position, and configuration of heating element 312 and secondary harvest heater 330 may vary while remaining within scope of the present subject matter. In addition, variations and modifications may be made to sweep arm 260, fill cup 214, and other features of ice making assembly 200.

Although a specific configuration and operation of ice making assembly 200 is described above, it should be appreciated that this is provided only for the purpose of explaining aspects of the present subject matter. Modifications and variations may be applied, other configurations may be used, and the resulting configurations may remain within the scope of the invention. For example, resilient mold 210 may define any suitable number of mold cavities 212, drive mechanism 276 may have a different configuration, or lifter mechanism 240 and sweep assembly 260 may have dedicated drive mechanisms. Furthermore, other control methods may be used to form and harvest ice cubes 204. One skilled in the art will appreciate that such modifications and variations may remain within the scope of the present subject matter.

Figure 11:
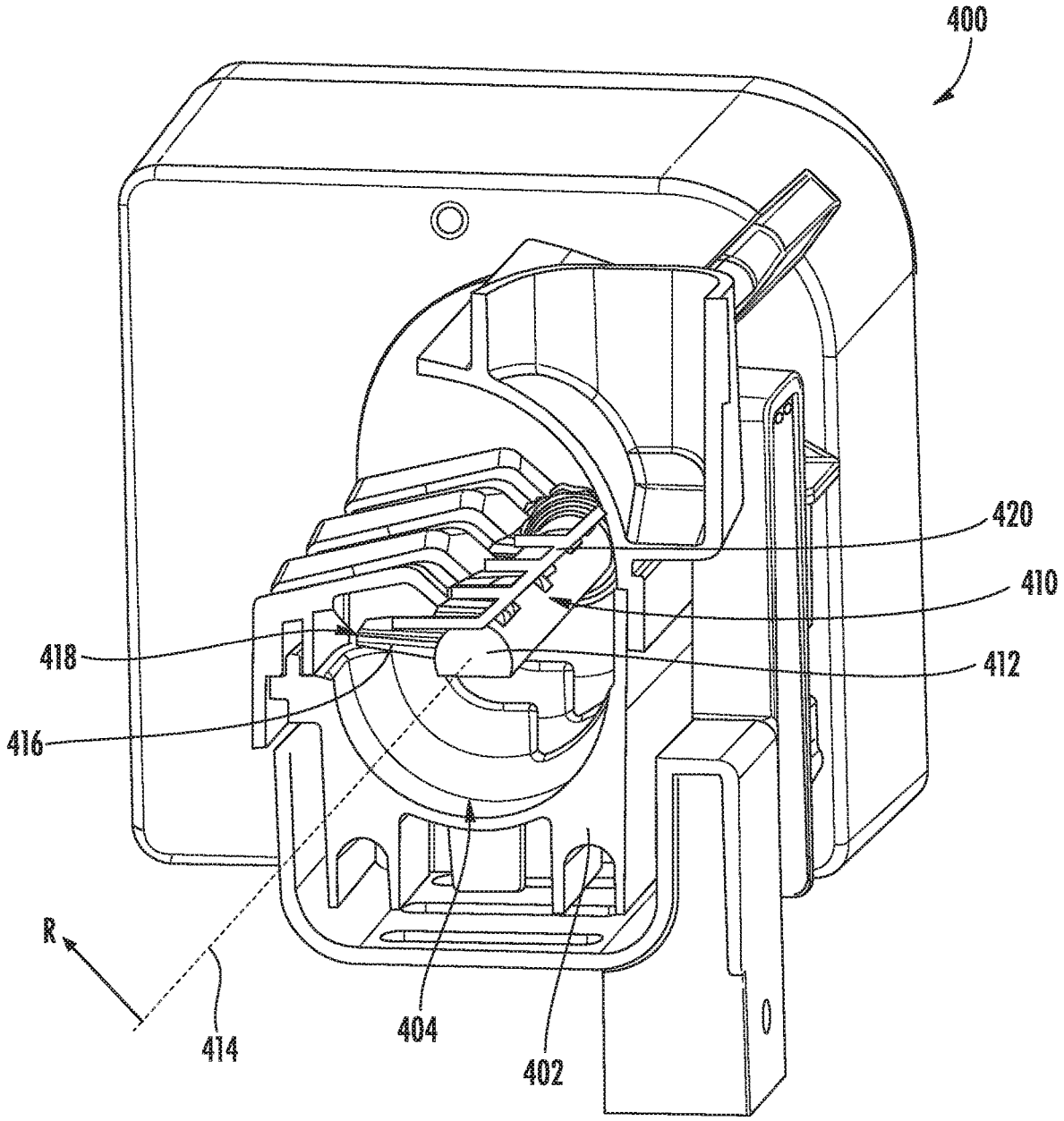
FIG. 11 provides a perspective cross sectional view of an ice making assembly for use with the exemplary refrigerator appliance of FIG. 1 according to another exemplary embodiment of the present subject matter.
Figure 12:
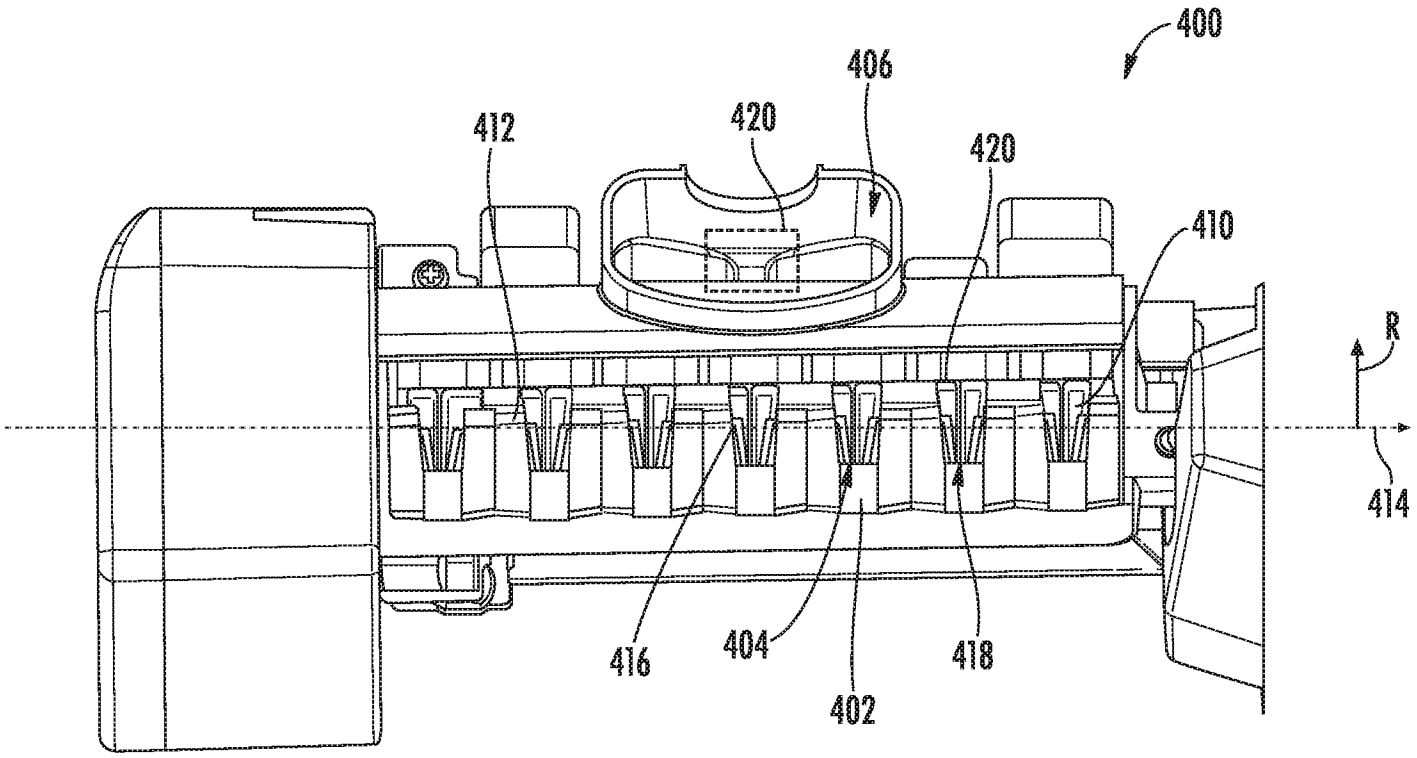
FIG. 12 provides a top perspective view of the exemplary ice making assembly of FIG. 11 according to another exemplary embodiment of the present subject matter.

Referring now specifically to FIGS. 11 and 12, an ice making assembly 400 will be described according to an alternative embodiment of the present subject matter. As shown, ice making assembly 400 is a crescent ice cube icemaker with integral heating features for reducing the likelihood of clogs and/or preventing ice buildup. Due to the similarity with the ice making assembly 200, like reference numerals may be used to refer to the same or similar features on ice making assembly 400.

As shown, ice making assembly 400 may include a heat exchanger 402 which defines a plurality of mold cavities 404 for receiving water from a fill spout 406. After mold cavities 404 have been filled with water and ice has formed, a sweep arm 410 may rotate to discharge the ice cubes. More specifically, sweep arm 410 may include an elongated shaft 412 that is rotatable about a central axis 414. A plurality of radial projections 416 may extend along a radial direction R from elongated shaft 412. As illustrated, radial projections 416 may be sized such that they extend to a distal end 418 that is almost in contact with heat exchanger 410. Notably, similar ice making assembly 200, ice buildup within or around heat exchanger 410 may cause jams and prevent sweep arm 410 from properly discharging ice cubes. Thus, according to the illustrated embodiment, ice making assembly 400 may include a heating element 420 that extends through sweep arm 410 and is selectively energized when a clog is detected. In this manner, elongated shaft 412 and radial projections 416 may contact and locally melt ice cubes and other ice buildup to release this ice from the mold cavity 404. In addition, referring still to FIG. 12, heating element 420 may be mounted on fill spout 406 to prevent ice buildup where water is discharged into mold cavities 404.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An ice making assembly for a refrigerator appliance, the ice making assembly comprising:

a resilient mold defining a mold cavity;

a fill cup positioned above the resilient mold for selectively filling the mold cavity with water;

a heat exchanger defining a cube recess that is configured to receive the resilient mold, the heat exchanger being in thermal communication with the resilient mold to freeze the water and form one or more ice cubes;

a heating element in thermal communication with the fill cup for selectively heating the fill cup; and a lifter mechanism positioned below the resilient mold and being movable between a lowered position and a raised position to at least partially separate the resilient mold from the heat exchanger and raise the ice cubes.

2. The ice making assembly of claim 1, wherein the fill cup comprises a discharge spout, and wherein the heating element is positioned adjacent the discharge spout.

3. The ice making assembly of claim 1, wherein the heating element is positioned on a back side of the fill cup opposite a discharge spout of the fill cup.

4. The ice making assembly of claim 1, wherein the heating element is positioned in a groove defined in the fill cup.

5. The ice making assembly of claim 1, wherein the heating element is secured in place by a retention bracket that snaps onto the fill cup.

6. The ice making assembly of claim 1, wherein the heating element is a resistance heating element.

7. The ice making assembly of claim 1, further comprising:

a secondary harvest heater in thermal communication with the heat exchanger.

8. The ice making assembly of claim 1, wherein the heat exchanger is positioned under the resilient mold and adjacent an inlet air duct for receiving a flow of cooling air.

9. The ice making assembly of claim 1, further comprising:

a sweep assembly positioned over the resilient mold and being movable between a retracted position and an extended position to push the ice cubes out of the resilient mold.

10. The ice making assembly of claim 9, further comprising:

a drive mechanism operably coupled to the lifter mechanism and the sweep assembly to selectively raise the lifter mechanism and slide the sweep assembly to discharge the ice cubes.

11. The ice making assembly of claim 10, wherein the fill cup is integrally formed with the sweep assembly and moves with the sweep assembly.

12. A refrigerator appliance defining a vertical direction, a lateral direction, and a transverse direction, comprising:

a cabinet defining a chilled chamber;

a door being rotatably mounted to the cabinet to provide selective access to the chilled chamber;

an icebox mounted to the door and defining an ice making chamber;

an ice making assembly positioned within the ice making chamber, the ice making assembly comprising:

a resilient mold defining a mold cavity;

a fill cup positioned above the resilient mold for selectively filling the mold cavity with water;

a heat exchanger defining a cube recess that is configured to receive the resilient mold, the heat exchanger being in thermal communication with the resilient mold to freeze the water and form one or more ice cubes;

a heating element in thermal communication with the fill cup for selectively heating the fill cup; and a lifter mechanism positioned below the resilient mold and being movable between a lowered position and a raised position to at least partially separate the resilient mold from the heat exchanger and raise the ice cubes.

13. A refrigerator appliance of claim 12, wherein the fill cup comprises a discharge spout, and wherein the heating element is positioned adjacent the discharge spout.

14. A refrigerator appliance of claim 12, wherein the heating element is positioned on a back side of the fill cup opposite a discharge spout of the fill cup.

15. A refrigerator appliance of claim 12, wherein the heating element is positioned in a groove defined in the fill cup.

16. A refrigerator appliance of claim 12, wherein the heating element is secured in place by a retention bracket that snaps onto the fill cup.

17. A refrigerator appliance of claim 12, further comprising:

a secondary harvest heater in thermal communication with the heat exchanger.

18. A refrigerator appliance of claim 12, further comprising:

a sweep assembly positioned over the resilient mold and being movable between a retracted position and an extended position to push the ice cubes out of the resilient mold; and a drive mechanism operably coupled to the lifter mechanism and the sweep assembly to selectively raise the lifter mechanism and slide the sweep assembly to discharge the ice cubes.

19. A refrigerator appliance of claim 18, wherein the fill cup is integrally formed with the sweep assembly and moves with the sweep assembly.

20. An ice making assembly for a refrigerator appliance, the ice making assembly comprising:

a mold defining a mold cavity;

a fill cup positioned above the mold for discharging water into the mold;

a sweep arm rotatably mounted to the mold and comprising a radial projections that sweeps through the mold cavity;

a heat exchanger defining a cube recess that is configured to receive the resilient mold, the heat exchanger being in thermal communication with the mold to freeze the water and form one or more ice cubes;

a heating element positioned within the fill cup for selectively heating the fill cup; and a lifter mechanism positioned below the mold and being movable between a lowered position and a raised position to at least partially separate the mold from the heat exchanger and raise the ice cubes.

* * * * *